United States Patent [19]

Stanislaw et al.

[11] 4,400,238

[45] Aug. 23, 1983

[54] APPARATUS FOR STRETCHING AN ENDLESS WEB

[75] Inventors: Peter P. Stanislaw, Highland Lakes; James S. Hicks, Sussex, both of N.J.

[73] Assignee: Morrison Machine Co., Paterson, N.J.

[21] Appl. No.: 373,113

[22] Filed: Apr. 29, 1982

[51] Int. Cl.[3] ..... D21F 7/00; D06C 3/06

[52] U.S. Cl. ..... 162/273; 26/51; 26/106; 28/142

[58] Field of Search ..... 162/273, 274; 26/51, 26/106; 28/142; 34/121

[56] References Cited

U.S. PATENT DOCUMENTS

| | | | |
|---|---|---|---|
| 4,220,501 | 9/1980 | Skaugen | 162/273 |
| 4,232,435 | 11/1980 | Eriksen | 162/273 |
| 4,256,537 | 3/1981 | Stanislaw | 162/273 |

*Primary Examiner*—Peter Chin

*Attorney, Agent, or Firm*—Lerner, David, Littenberg, Krumholz & Mentlik

[57] ABSTRACT

An apparatus for processing an endless web includes means for supporting the endless web at a first location and a roll for supporting the endless web at a second location. The roll has first and second ends. First and second carriages are engaged to first and second substantially parallel tracks respectively for rotatably supporting the first and second ends of the roll respectively in a normal operating position and for moving the roll relative to the support means along the tracks. A bridge connects the first and second carriages. Means are mounted to the bridge for lifting the roll at a location between the first and second ends, whereby the roll is supported by the lifting means and the first carriage, whereby the endless web may be inserted or removed over the second end of the roll.

The lifting means includes a cradle for supporting the roll, means for moving the cradle into and out of a position underneath the roll and means for elevating the cradle while the cradle is in the position under the roll. In a first embodiment of the invention, the elevating means comprises an inflatable cushion adapted to be inflated and thereby raise the cradle and to be deflated and thereby lower the cradle. In a second embodiment, the elevating means includes a block adapted to rest on the ground, a first link pivotally mounted to the block and a second link pivotally mounted to the cradle. A pivot joins the other ends of the two links and means are provided for moving the pivot from a first position horizontally displaced from the first ends of the links, wherein the cradle is in a lowered position, and a second position where the pivot means is substantially vertically aligned with the block and the cradle, whereby the cradle is in an elevated position.

17 Claims, 29 Drawing Figures

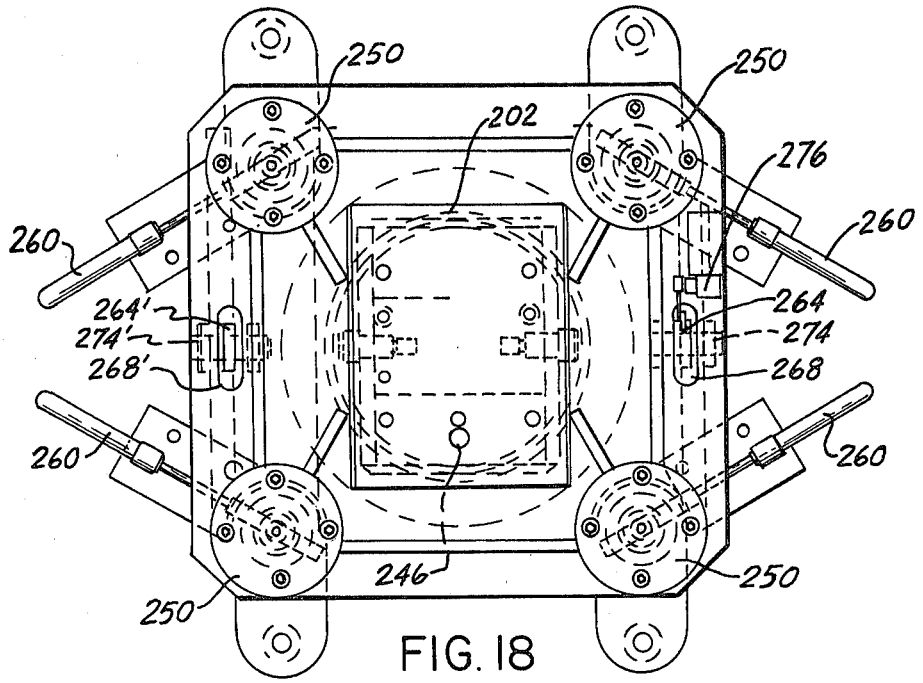
FIG. 18
FIG. 19
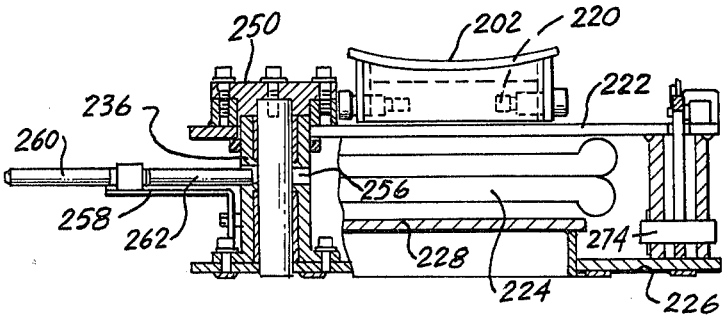
FIG. 20
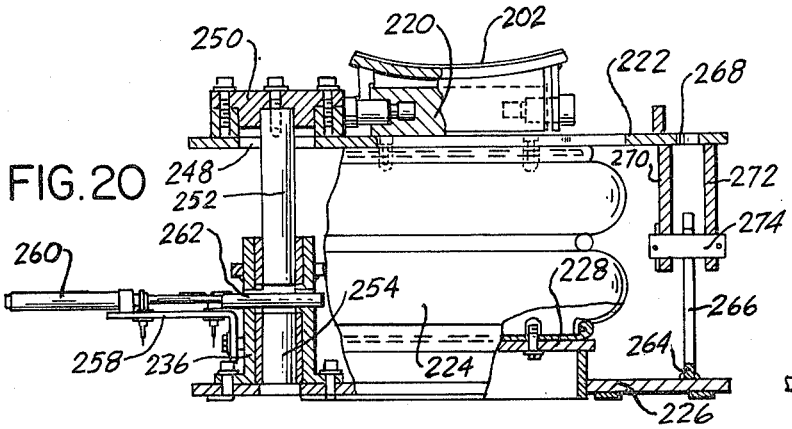
FIG. 21
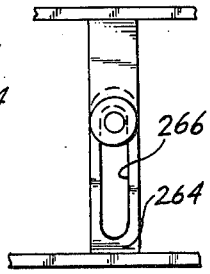

APPARATUS FOR STRETCHING AN ENDLESS WEB

FIELD OF THE INVENTION

The present invention relates generally to apparatus for stretching endless webs, such as blankets for paper making machines, and specifically to an improved apparatus and arrangement for lifting and supporting the stretch roll of such apparatus so that the endless webs may be readily removed and changed.

BACKGROUND OF THE INVENTION

In U.S. Pat. No. 4,256,537, which issued Mar. 17, 1981 and which is incorporated herein by reference, there is disclosed an apparatus for stretching and tensioning an endless web, such as a blanket. The apparatus includes a support for supporting the endless web at a first location, a roll for supporting the endless web at a second location, and a carriage movable along a track (which extends between the first and second locations) for rotatably supporting the roll in a normal operating position and for moving the roll relative to the support means. The carriage means includes a first carriage section and a second carriage section engaged with the track. The first carriage section includes a roll support means for lifting one end of the roll to a position above the normal operating position. The second carriage section includes a second roll support means for maintaining the roll in the lifted position without support of the first roll support means so that the endless web may be removed. This is preferably accomplished by a support arm which extends from the second carriage section and a movable saddle element supported on the support arm for engaging the underside of and supporting the roll in the lifted position.

While the apparatus disclosed in the aforesaid patent was an improvement over prior systems, it has proven to be relatively expensive to manufacture. Additionally, it is believed to be relatively inefficient to provide an elaborate and expensive jacking apparatus in the first carriage section and to provide a separate and independent support arm mechanism at a remote location which serves the sole purpose of holding the roll in an elevated position once it has reached that elevated position.

Accordingly, it is an object of the present invention to provide an improved apparatus for stretching an endless web which overcomes the aforesaid problems and improves upon the apparatus disclosed in U.S. Pat. No. 4,256,537.

It is a further object of the present invention to provide such an apparatus which is less expensive to manufacture than the aforesaid device.

It is another object of the present invention to provide such an apparatus in which the mechanisms for lifting the roll to an elevated position and for retaining the roll in the elevated position are within the same mechanism.

Various other objects and advantages of the present invention will become clear from the following detailed description of several exemplary embodiments thereof, and the novel features will be particularly pointed out in conjunction with the claims appended hereto.

SUMMARY OF THE INVENTION

In accordance with the teachings of the present invention, an apparatus for processing an endless web includes a support means for supporting the endless web at a first location thereof, a roll for supporting the endless web at a second location thereof, the roll having first and second ends. First and second track means extend between the first and second locations. First and second carriage means are engaged to the first and second track means respectively for rotatably supporting the first and second ends of the roll respectively in a normal operating position and moving the roll relative to the support means along the track means. A bridge means connects the first and second carriage means. Means are mounted to the bridge means for lifting the roll at a location between the first and second ends so that the roll is supported by the lifting means and the first carriage means so that the endless web may be inserted or removed over the second end of the roll.

The invention will be more fully understood by reference to the following detailed description of several exemplary embodiments thereof in conjunction with the accompanying drawings in which:

FIG. 18 is a plan view of a portion of the lifting means illustrated in FIG. 13 in a different scale showing additional detail;

FIG. 19 is a partially cutaway right side elevational view of the lifting means illustrated in FIG. 18, in which the lifting means is in its lowered position;

FIG. 20 is a view similar to FIG. 19 in which the lifting means is in its raised position;

FIG. 21 is a partial rear elevational view of the lifting means as illustrated in FIG. 20;

DESCRIPTION OF THE PREFERRED EMBODIMENT

Figure 1:
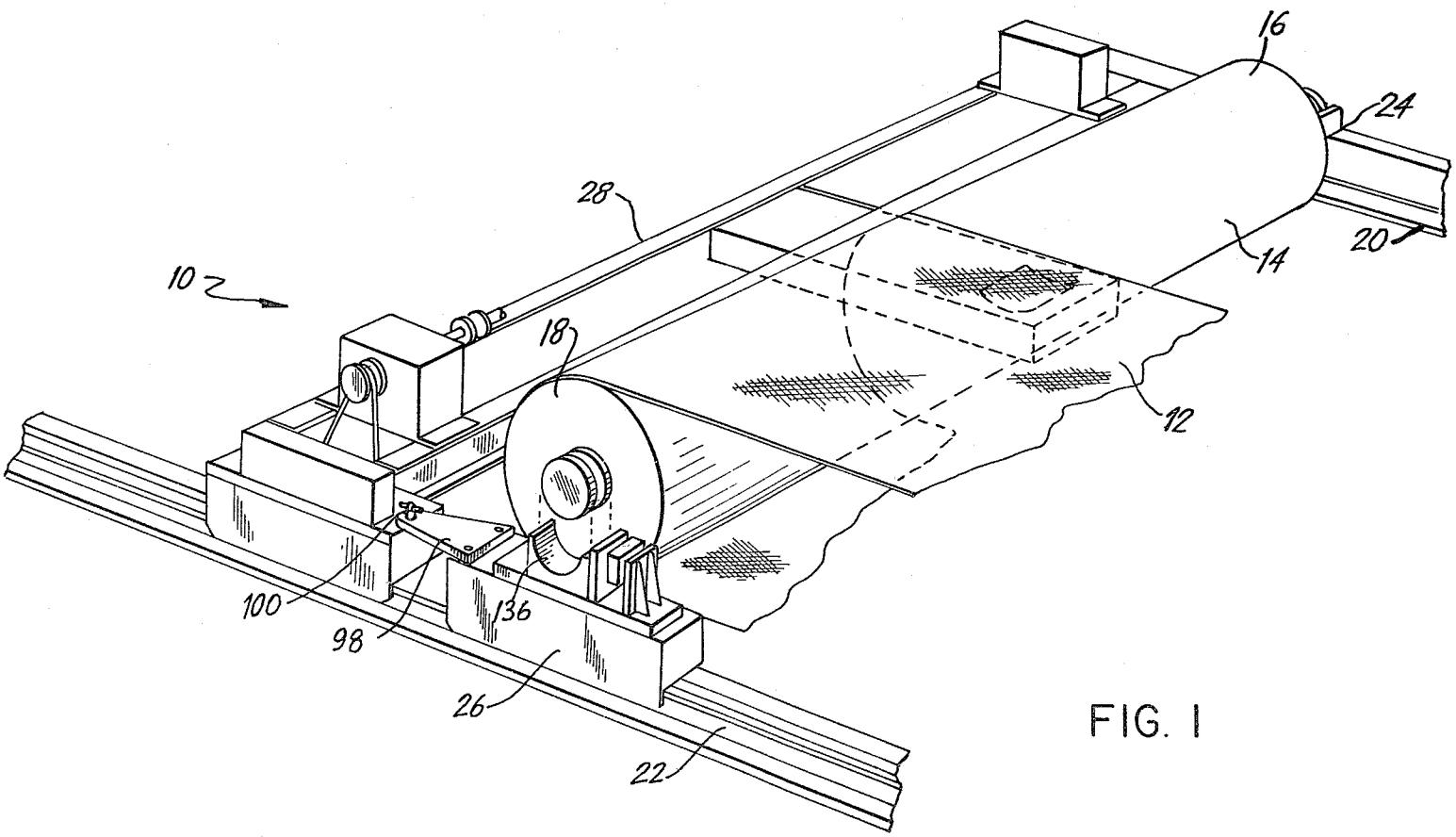
FIG. 1 is a perspective view of the presently preferred embodiment of a stretching apparatus employing the principles of the present invention.

Referring now to the drawings, wherein like reference numerals designate like parts throughout the several views, the present invention is illustrated generally in FIG. 1, wherein the stretching apparatus is referred to generally by reference numeral 10. As shown in FIG. 1, the endless web 12 is supported by roll 14 which has a first end 16 and a second end 18. The web 12 is supported by the roll 14 and is also supported by another roll (not shown) or suitable processing apparatus, such as a loom for processing the web.

A first track 20 and a second track 22, which are parallel, extend between the processing apparatus or other roll and at least as far as a second location which is sufficiently distant to allow for the maximum stretching of an endless web 12, as will become clearer below. Mounted to the first track 20 is a first carriage 24 and, similarly, mounted to the second track 22 is a second carriage 26. As will be explained in much greater detail below, a bridge 28 straddles and is engaged with both tracks 20, 22.

For reasons which will become clear below, the side of the stretching apparatus 10 which appears in the lower left-hand corner of FIG. 1 is referred to as the "cantilever side" while the other side is referred to as the "pivot side". Generally speaking, when the lifting mechanism in the present invention is operated, the second end 18 of the roll 14 is lifted above the second carriage 26 to allow the web 12 to be removed, while, at the same time, the first end 16 of the roll 14 continues to rest in the first carriage 24 and pivots about it.

Figure 2:
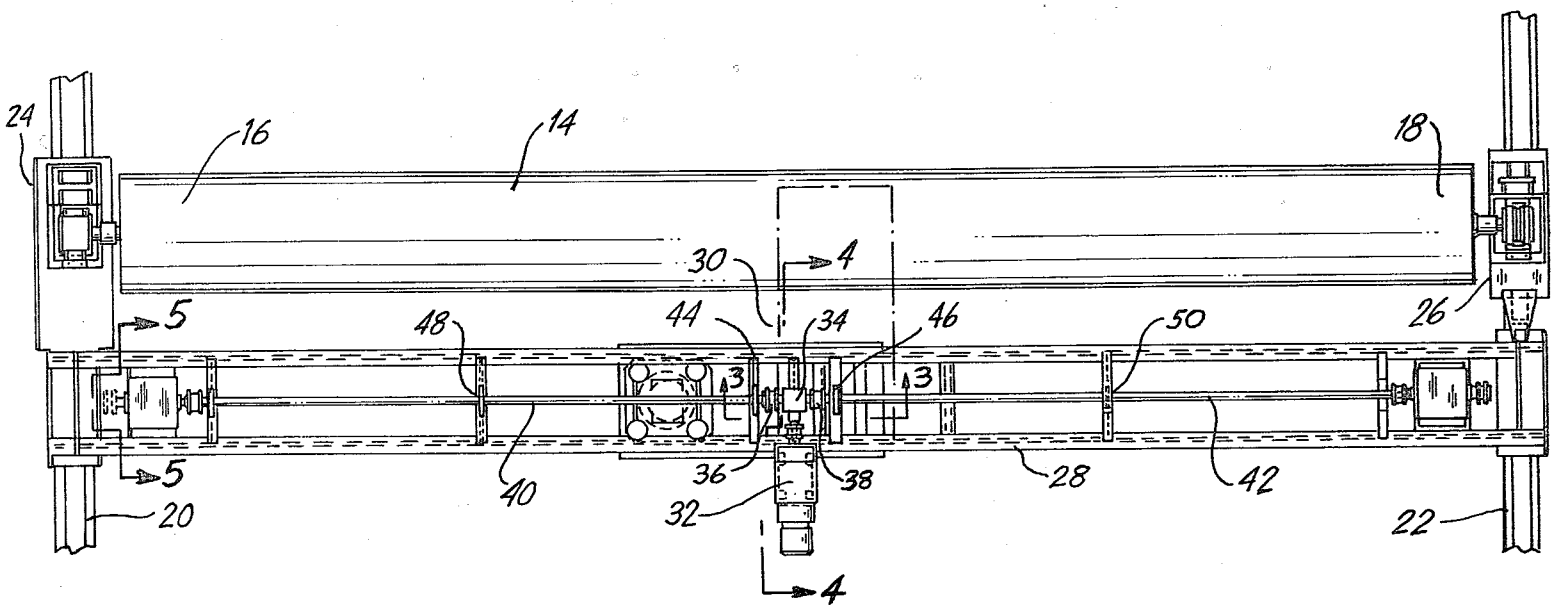
FIG. 2 is a plan view of the stretching apparatus illustrated in FIG. 1.

Referring now to FIG. 2, the general layout of the preferred embodiment of the present invention can be fully appreciated. The roll 14, which is a drum having a diameter of 32 inches and a length of approximately 360 inches, stretches from the pivot or left side to the cantilever or right side as shown in FIG. 2. The bridge 28, which extends from the first track 20 to the second track 22, includes the lifting mechanism 30, which is described in greater detail below, and which is located near (but preferably not at) the center of the bridge 28 and the roll 14.

Figure 3:
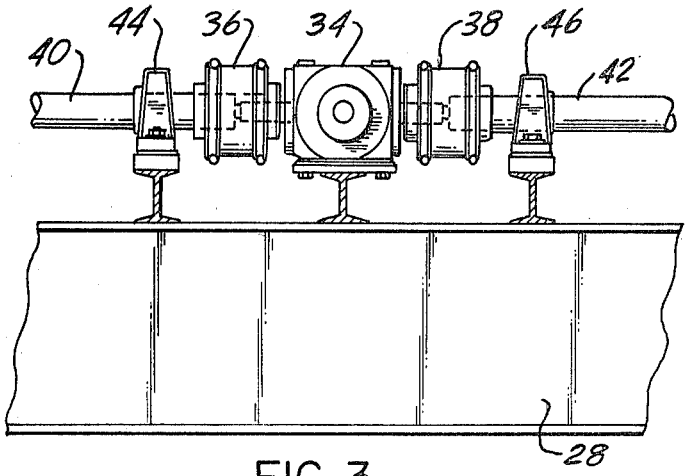
FIG. 3 is a partial front elevational section view taken along line 3—3 in FIG. 2 and looking in the direction of the arrows.
Figure 4:
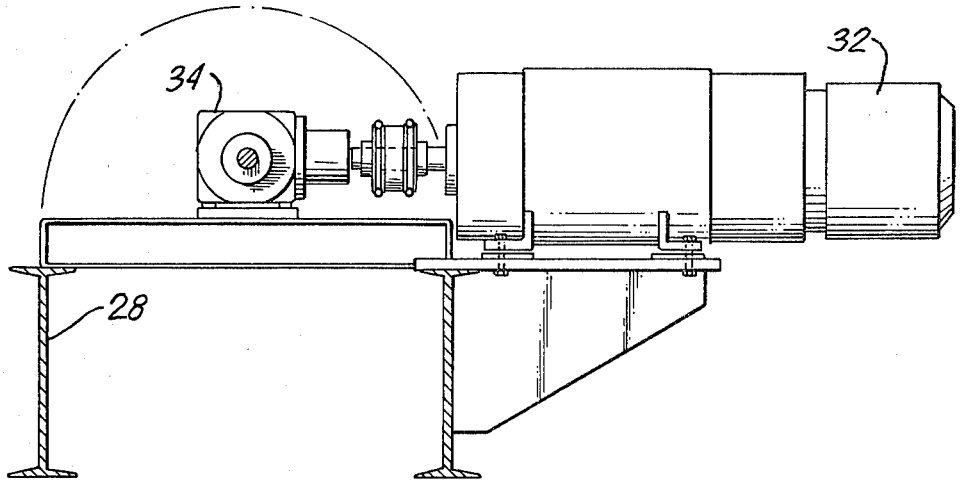
FIG. 4 is a partial left side elevational section view taken along line 4—4 in FIG. 2 and looking in the direction of the arrows.
Figure 10:
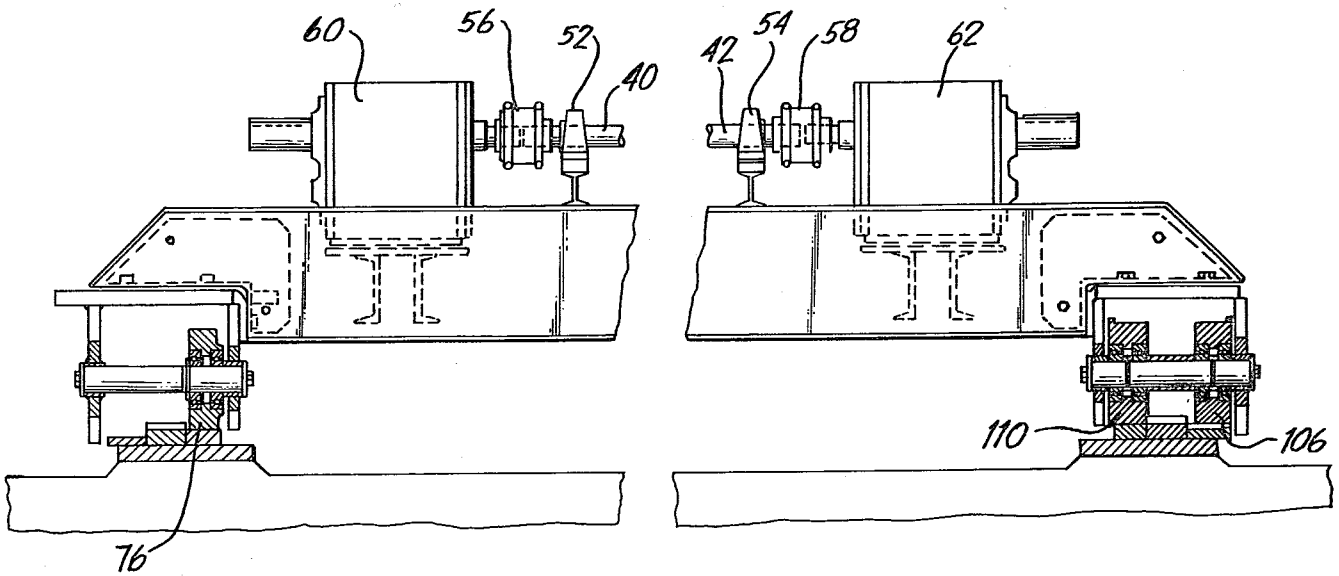
FIG. 10 is a broken front elevational view of the stretching apparatus illustrated in FIGS. 1 and 2.

As best illustrated in FIGS. 3 and 4, mounted to the bridge 28 is a motor 32 which is used to propel the stetching apparatus 10 along the tacks 20, 22. The motor 32, which is preferably a 10 horsepower motor, is connected through gear box 34, couplings 36, 38 and pillow blocks 44, 46 to shafts 40, 42. The shafts 40, 42 extend through additional pillow blocks 48, 50 respectively, as illustrated in FIG. 2. Thereafter, as shown in FIG. 10, the shafts 40, 42 are connected through pillow blocks 52, 54 through couplings 56, 58 into speed reducers 60, 62 respectively.

Figure 11:
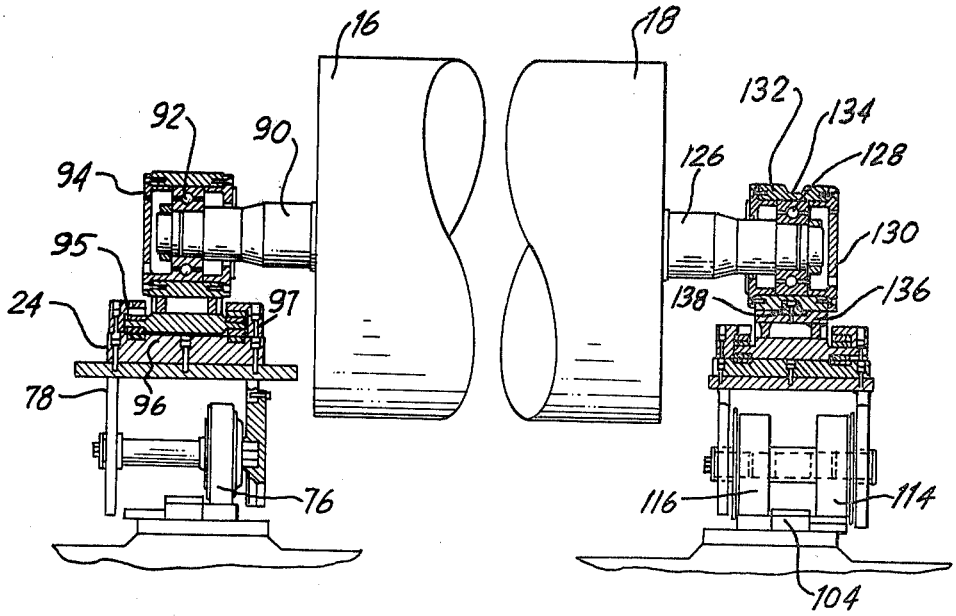
FIG. 11 is a broken front sectional elevational view taken along line 11—11 in FIGS. 6 and 8 and looking in the direction of the arrows.
Figure 12:
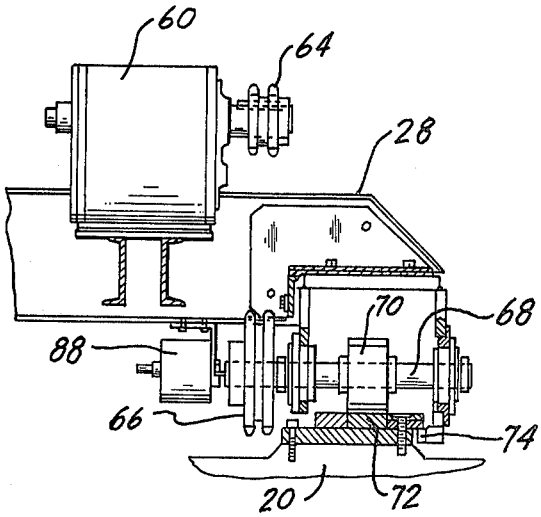
FIG. 12 is a partial rear elevational section view taken along line 12—12 in FIG. 6 and looking in the direction of the arrows, which has been cut away to illustrate only the details of the left side, the details of the right side being substantially the same.

Turning now to FIGS. 6, 7 and 10 through 12, the construction of the pivot side of the bridge 28 can be understood. As best seen in FIG. 12, the output of the reducer 60 is connected to a sprocket 64, which is connected by a chain (not shown) to a sprocket 66. Sprocket 66, in turn, is mounted to shaft 68, to which is mounted a cart pinion 70. The cart pinion 70 is designed to be engaged with the rack portion 72 of the first track 20. Thus, it can be seen that the rotary motion from the motor 32 is transmitted through the shaft 40, the reducer 60, the sprockets 64, 66, the shaft 68 and the pinion 70 to drive the pivot side of the bridge 28 along the first track 20. A bearing 74 is provided to prevent upward movement of the bridge 28 and to assist in preventing the pivot side of the bridge 28 from being lifted off the first track 20. An encoder 88 is provided for the purpose of measuring the rotation of the shaft 88 to determine the location of the apparatus 10 along the tracks 20, 22. The readout of the encoder 88 is transmitted to the operator's control panel (not shown).

Figure 5:
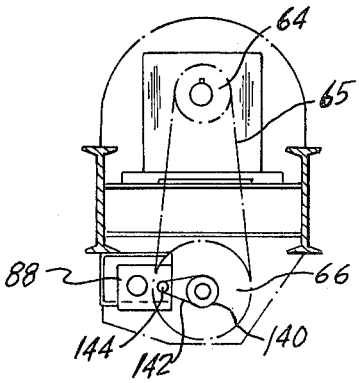
FIG. 5 is a partial left side elevational section view taken along line 5—5 in FIG. 2 and looking in the direction of the arrows.

FIG. 5 shows another view of the driving mechanism illustrated in FIG. 12. As seen in FIG. 5, the sprocket 64 drives the sprocket 66 through chain 65, which is shown schematically with a phantom line. As also shown in FIG. 5, a pulley 140, through a belt 142, drives an additional pulley 144 which operates as the input to the encoder 88 which was as previously described.

Figure 6:
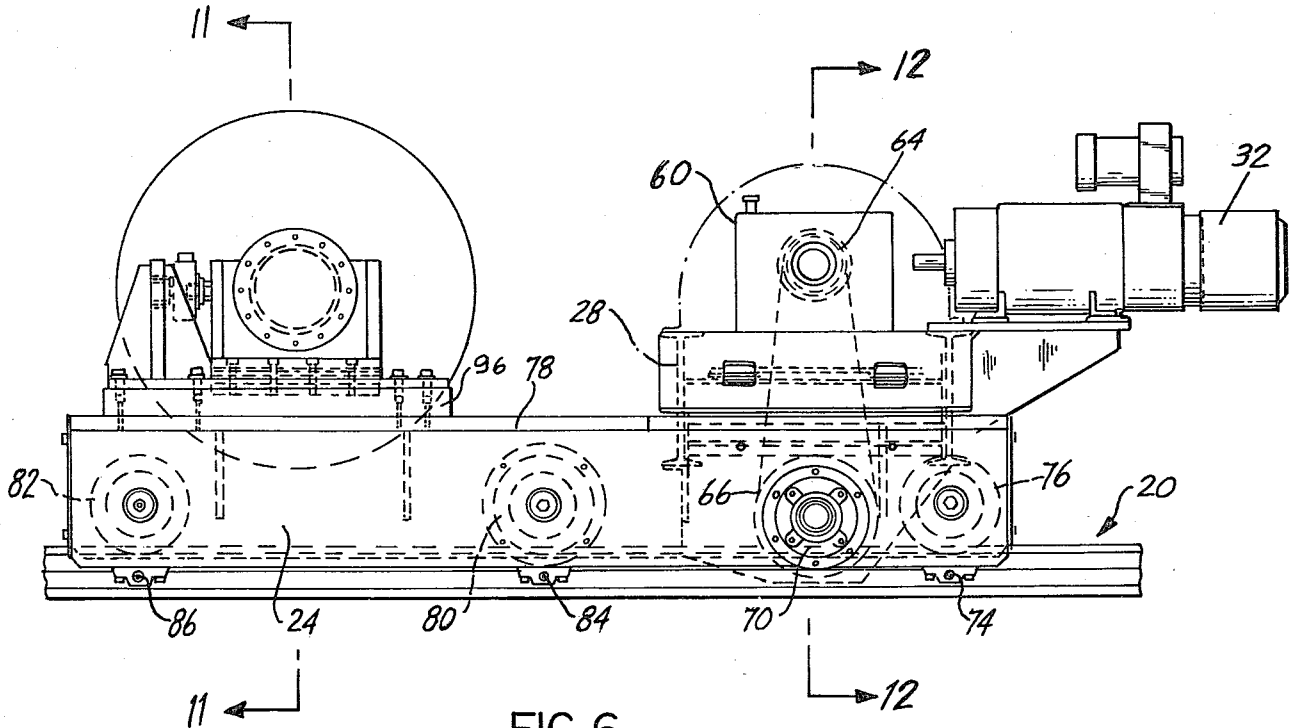
FIG. 6 is a left side elevational section view of the stretching apparatus illustrated in FIGS. 1 and 2, illustrating what will be referred to as the "pivot side"

The location of the pinion 70 is essentially in vertical alignment with the sprocket 64, as best seen in FIG. 6. As can also be best seen in FIG. 6, the pivot side of the bridge 28 also includes a wheel 76 which rests on and rolls along a flat portion of the first track 20. The lateral positioning of the wheel 76 is best illustrated in FIG. 11.

Figure 7:
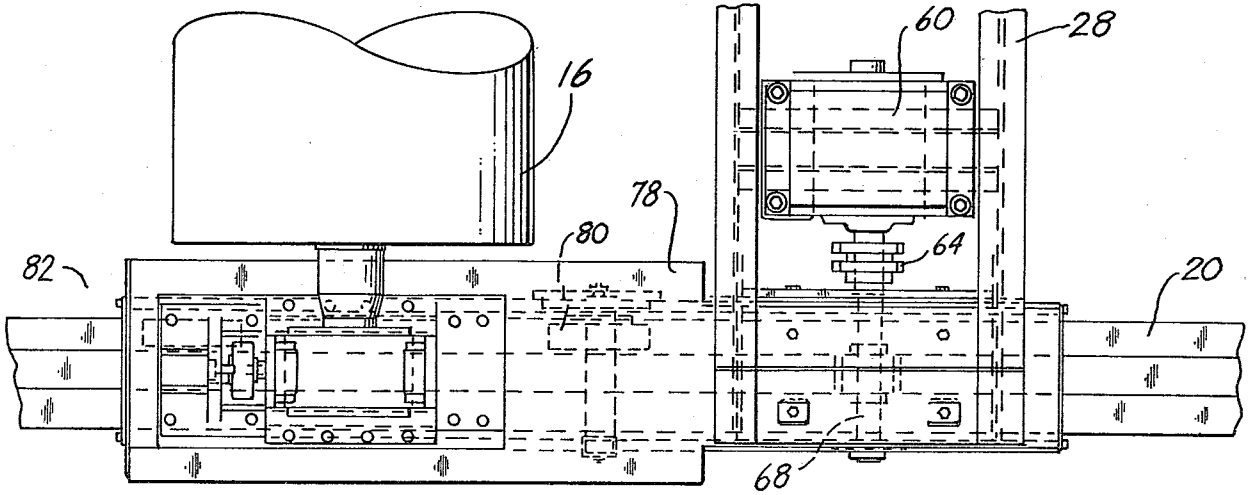
FIG. 7 is a partial plan view of the left-hand end of the stretching apparatus as illustrated in FIG. 6.

On the pivot side of the stretching apparatus 10, the bridge 28 is integral with and rigidly connected to the first carriage 24, in contrast to the detachable arrangement on the cantilever side, which will be discussed below. On the pivot side, as best seen in FIGS. 6 and 7, there is a unitary side frame 78. In addition to the wheel 76 located near the front of the side frame 78, there are additional wheels 80, 82 located near the middle and near the rear end of the side frame 78. Each of the wheels 76, 80 and 82 are mounted internally with respect to the pinion 70, as shown in FIG. 10 in conjunction with FIGS. 7 and 11. Additional bearings 84, 86 are positioned near the wheels 80, 82 respectively to assist in preventing the apparatus from lifting off the first track 20.

The left side of FIG. 11 illustrates the manner in which the first end 16 of the roll 14 is carried on the first carriage 24. A tapering shaft 90 extends from the first end 16 of the roll 14 into a roller bearing 92 which, in turn, is housed in a bearing housing 94. The bearing housing 94 is mounted through a series of fasteners to a support plate 96 which is rigidly mounted to the side frame 78. The bearing housing 94 is slidably mounted to the support plate 96 through horizontal linear bearings 95. 97. This is done in a like manner on the cantilever side as shown in FIG. 11.

As will be explained below, due to the operation of the stretching apparatus 10, the second end 18 of the roll 14 will be lifted upward while the first end 16 remains at the same height. This will result in a pivoting of the tapering shaft 90 at the pivot side of the apparatus. However, it should be appreciated and understood that the degree of elevation of the second end 18 of the roll is a matter of approximately ten inches, while the roll itself is 360 inches long, which translates into a pivoting angle of approximately one to two degrees. This is within the normal angular tolerances of the bearing 92. It has been found that an SKF spherical roll bearing No. 22320-C will suffice for this purpose.

Figure 8:
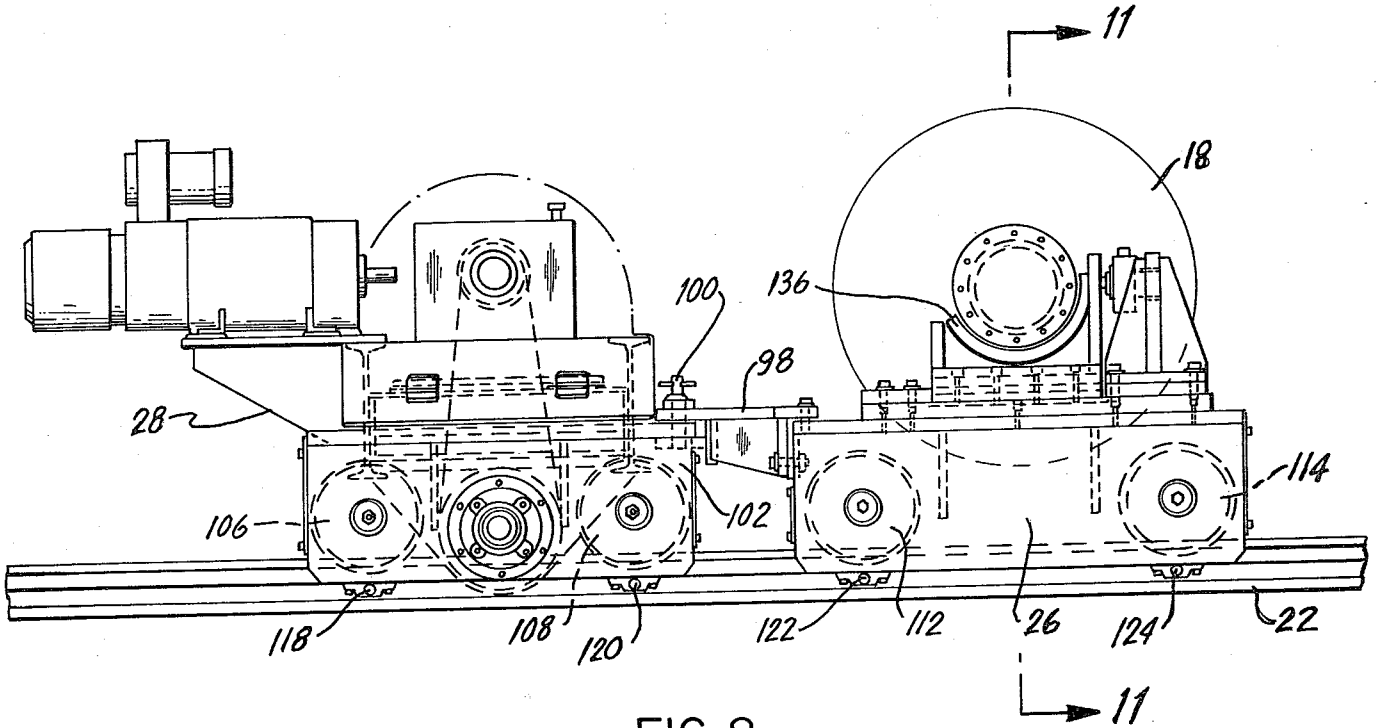
FIG. 8 is a right side elevational section view of the stretching apparatus illustrated in FIGS. 1 and 2, illustrating what will be referred to as the "cantilever side"
Figure 9:
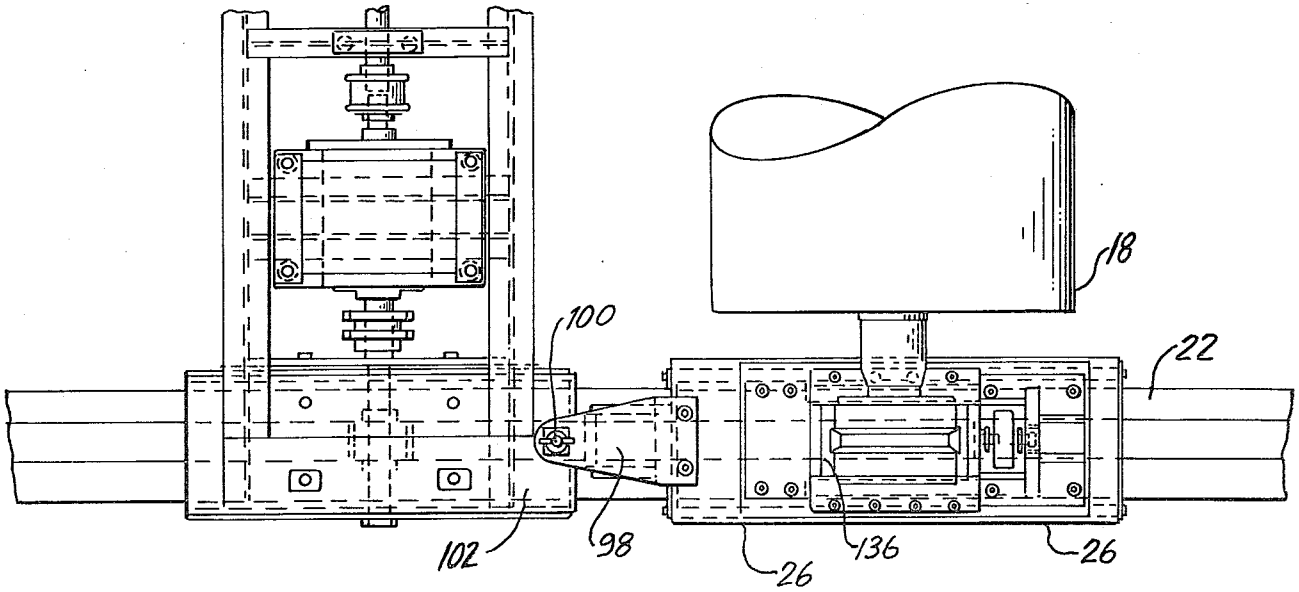
FIG. 9 is a partial plan view of the right-hand end of the stretching apparatus as illustrated in FIG. 8.

Turning now to the cantilever side of the stretching apparatus 10, it can be seen in FIGS. 1, 8 and 9 that the second carriage 26 is detachable from the bridge 28, as distinguished from the arrangement on the pivot side which was previously discussed. As best seen in FIGS. 8 and 9, attached to the second carriage 26 is a clevis 98. A disconnect pin 100 can be releasably inserted through the clevis 98 and through an appropriate hole in the side frame 102 of the cantilever side of the bridge 28 to releasably connect the second carriage 26 and the bridge 28.

The cantilever side of the bridge 28 is substantially similar to the construction of the pivot side with a few exceptions. As best seen in FIGS. 8, 10 and 11, the cantilever side of the bridge 28 (as well as the second carriage 26) has wheels on both the inside and outside of the rack 104 of the second track 22. In particular, the cantilever side of the bridge 28 has an outer front wheel 106 and an outer rear wheel 108. In addition, as best seen in FIG. 10, there is an inner front wheel 110 on the same shaft as the outer front wheel 106 as well as an inner rear wheel (not shown) on the same shaft as the outer rear wheel 108. Similarly, the second carriage 26 (which, it will be recalled, is detachable from the bridge 28) has an outer front wheel 112, an outer rear wheel 114 and, as best seen in FIG. 11, an inner rear wheel 116 on the same shaft as the outer rear wheel 114 as well as an inner front wheel (not shown) on the same shaft as the outer front wheel 112. The second carriage 26 is provided with double wheels because, as will be explained below, in operation, the second carriage can and will be moved independently of the bridge 28, and the double wheels provide greater rolling stability.

The cantilever side of the stretching apparatus also features bearings 118, 120, 122 and 124 near each pair of wheels (see FIG. 8) which, like the comparable bearings 74, 84 and 86 on the pivot side, prevent the cantilever side of the bridge 28 and the second carriage 26 from moving upward with respect to the second track 22.

The other significant difference between the cantilever side of the stretching apparatus 10 and the pivot side resides in the fact that the second end 18 of the roll 14 on the cantilever side may be lifted upward with respect to the second carriage 26 to allow a web 12 to be placed on or taken off the roll 14. As best illustrated in FIG. 11, the second end 18 of the roll 14 extends into a tapering shaft 126 which rests in a bearing 128 similar to the bearing 92. The bearing 128 rests in a bearing housing 130. However, the bearing housing 130 has a cylindrical sidewall 132 which has a truncated V-shaped groove 134.

The sidewall 132 is not rigidly attached to any support. Instead, it rests in a roughly U-shaped support 136 as best illustrated in FIG. 8. The U-shaped support 136 includes a protruding member 138 which has a truncated A shape designed to engage with the truncated V-shaped groove 134. The engagement of the truncated V-shaped groove 134 with the protruding truncated A-shaped member 138 assists in guiding the entire bearing housing 130 downward when the second end 18 of the roll 14 is lowered.

Figure 13:
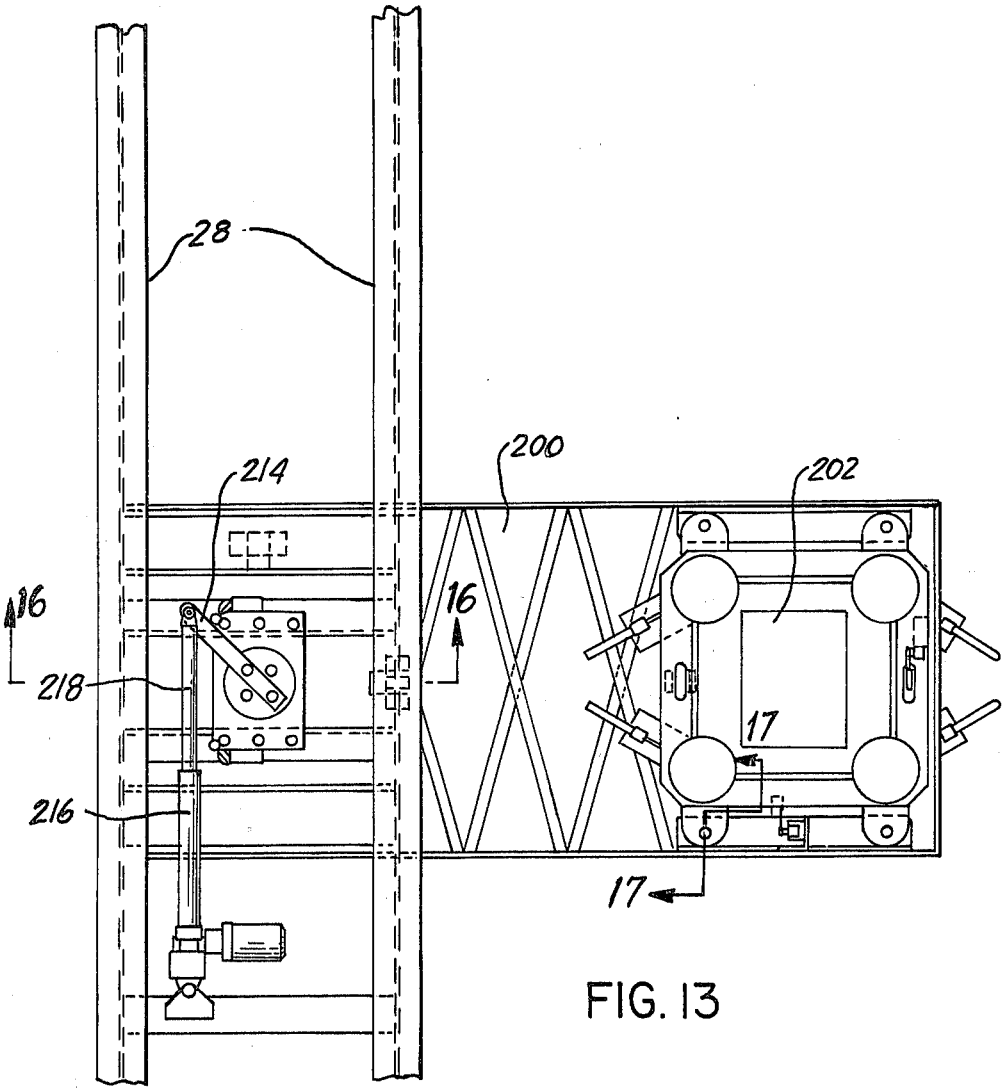
FIG. 13 is a plan view of the lifting means of the embodiment illustrated in FIGS. 1 and 2.
Figure 14:
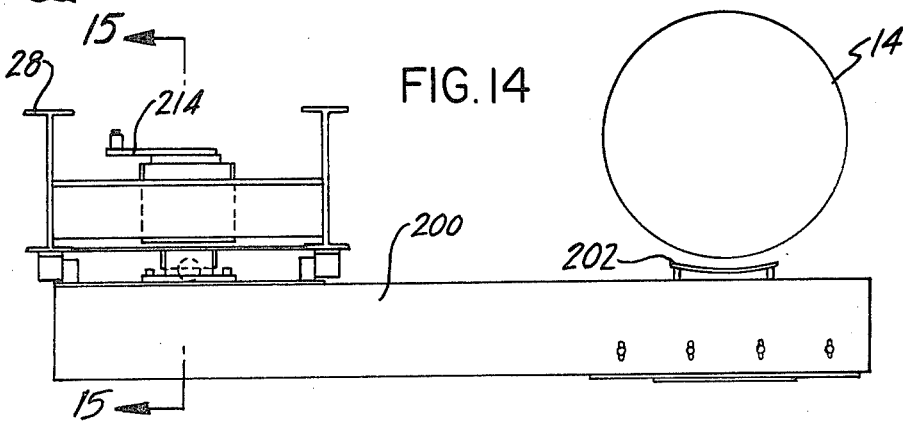
FIG. 14 is a right side elevational view of the lifting means illustrated in FIG. 13.

The lifting mechanism in the preferred embodiment of the present invention is illustrated in FIGS. 13 through 21. As seen in FIGS. 13 and 14, the lifting mechanism includes a pivot frame 200 to which is mounted a cradle 202, which has a shallow U shape and which is adapted to engage the underside of the roll 14, as will be explained below. A pivot frame 200 is mounted to the underside of the bridge 28 to pivot approximately 90° between a position wherein the pivot frame 200 is perpendicular to the bridge 28 as seen in FIG. 13, and a position wherein it is stored underneath the bridge 28. The pivot frame 200 is mounted to the bridge 28 at a location which is preferably approximately 12 inches from the center line of the bridge 28 and the roll 14 and nearer to the cantilever side. This is done so that the center of gravity of the roll 14 will be between the pivot frame 200 and the pivot side. Because of this, when the lifting mechanism is activitated, with the center of gravity between the lifting mechanism and the pivot side, both the lifting mechanism and the first carriage 24 exert an upward force on the roll 14. If the center of gravity were to be on the cantilever side of the lifting mechanism, the pivot side of the roll 14 would then have a tendency to lift upward, which would place unsatisfactory tension forces on the pivot side.

Figure 15:
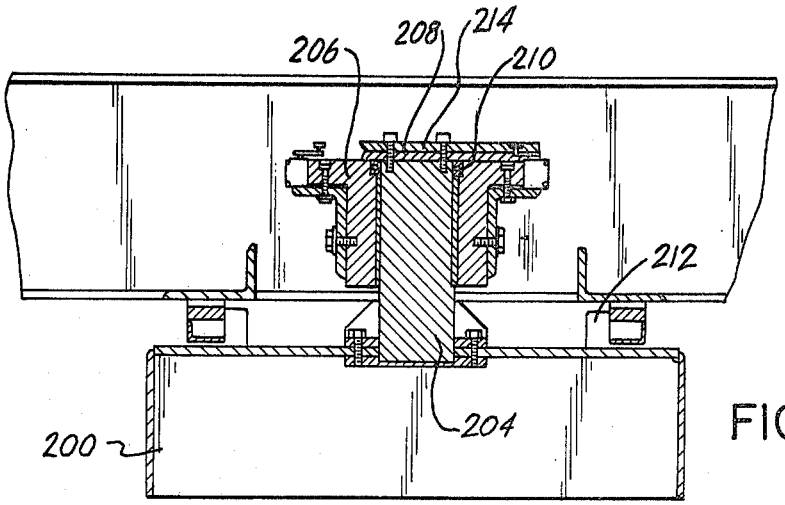
FIG. 15 is a rear elevational partial sectional view taken along line 15—15 in FIG. 14 and looking in the direction of the arrows.
Figure 16:
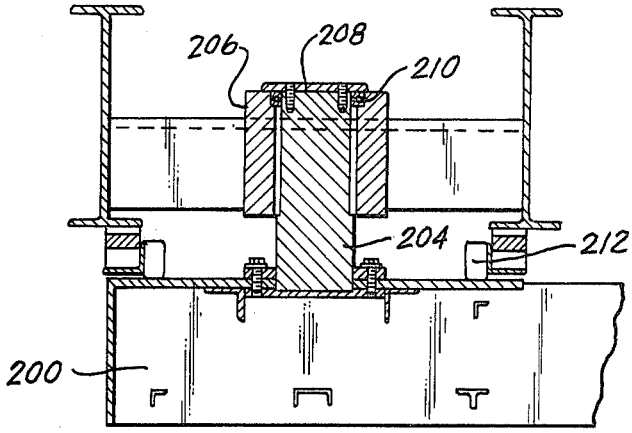
FIG. 16 is a right side elevational partial sectional view taken along line 16—16 in FIG. 13 and looking in the direction of the arrows.

As illustrated in FIGS. 15 and 16, a pivot shaft 204 is rigidly mounted to the pivot frame 200. The upper portion of the pivot shaft 204 rests in a mounting block 206 which is rigidly mounted to the bridge 28. A pivot shaft cap 208 is fastened to the pivot shaft 204 and a thrust bearing 210 allows the pivot shaft 204 and the pivot shaft cap 208 to rotate internally with respect to the mounting block 206 and also allows the mounting block 206 to support the rather substantial weight of the pivot frame 200 and its attachments at the outer end. This entire arrangement acts, in effect, as a thrust bearing. Bearings 212 (of which there are preferably four, spaced 90° apart) are mounted to the underside of the bridge 28 to abut against the top surface of the pivot frame 200 to prevent the pivot frame 200 from bending with respect to the bridge 28.

Rigidly mounted to the pivot shaft cap 208 is a pivot arm 214. As best seen in FIG. 13, mounted to the bridge 28 is an electrical actuator 216 which is designed, on appropriate signal, to cause an actuator arm 218 to extend outward or be retracted inward. It can be appreciated from FIG. 13 that when the actuator arm 218 is retracted into the electrical actuator 216, the pivot arm 214 is caused to rotate counterclockwise, which causes the entire pivot frame 200 (which, it will be recalled, is rigidly mounted to the pivot shaft 204) to also pivot in a counterclockwise direction to a location whereby the entire pivot frame is located underneath the bridge 28. Likewise, when the actuator 216 is operated to cause the actuator arm to extend outward, the pivot arm 214 is caused to rotate clockwise which, in turn, causes the entire pivot frame 200 to move clockwise as seen in FIG. 13.

As best illustrated in FIGS. 19 and 20, the cradle 202 is mounted to a cradle mounting base 220 which, in turn, is rigidly mounted to a top jack base 222. The top jack base 222 rests on an inflatable cushion 224 which is preferably a Firestone Airstroke Actuator, Series 21 having four-ply construction. The inflatable cushion 224 in turn rests on the bottom jack base 226 and, in particular, an elevated platform portion 228. The top jack base 222 and the bottom jack base 226 are connected through slide mechanisms, which will be discussed in greater detail below.

Figure 17:
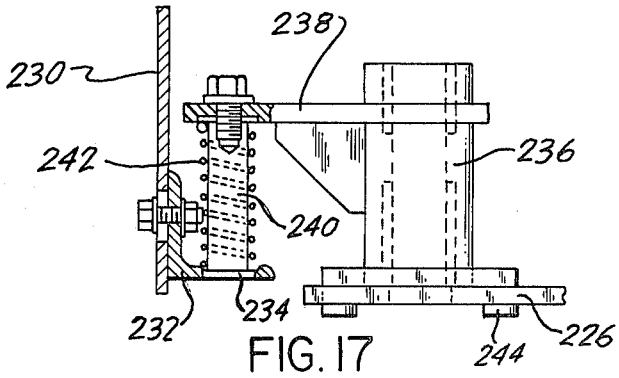
FIG. 17 is a rear elevational partial sectional view looking along line 17—17 in FIG. 13 and looking in the direction of the arrows.

The mounting of the bottom jack base 226 to the pivot frame 200 can be best understood by reference to FIGS. 13 and 17, where it will be appreciated that the bottom jack base 226 is actually suspended from the pivot frame 200 at four corners. In particular, referring to FIG. 17, a sidewall 230 of the pivot frame 200 includes an inwardly projecting shelf 232 which includes an aperture 234. Mounted to the bottom jack base 226 to each corner is a bushing support 236, to which there is rigidly mounted an outwardly extending flange 238. A guide pin 240 is mounted to the flange 238 and projects downwardly therefrom. A spring 242 surrounds the guide pin 240 and has a diameter such that it cannot pass through the aperture 234 but instead is stopped against the shelf 232. Thus, it can be seen that the jacking mechanism is mounted to the pivot frame 200 and is actually suspended from it by means of the four springs 242. The springs should be selected with an appropriate spring constant such that the weight of the bottom jack base 226 and all components which it supports deflect the springs 242 by an amount whereby the lowest components of the bottom jack base 226, namely the feet 244, normally rest above the ground level. This will, of course, depend on the weight of various components and other variables. It has been found that the use of four Lee Springs, Part No. LHC-218T-7, results in a clearance of approximately one-half inch off the ground.

The inflatable cushion 224 is inflated and deflated through a pipe tap 246 on the upper surface thereof, as illustrated in FIG. 18. As can be seen in FIGS. 18 and 20, the inflatable cushion 224 is essentially shaped like a contoured inner tube having a generally circular shape when seen in the plan view of FIG. 18.

It will be appreciated and understood that allowing the cradle 202 to be lifted solely by the inflation of the inflatable cushion 224 might result in a somewhat irregular movement and possible canting of the cradle 202. Moreover, to allow the enormous weight of the roll 14 to be supported solely by the inflatable cushion 224 (along with, of course, the first carriage 24) also poses the potential risk of a sudden drop if, for some reason, the inflatable cushion 224 were to be punctured or if the air was otherwise exhausted from the inflatable cushion 224.

These problems are overcome by virtue of having locking slide mechanisms on each corner of the top jack base 222. As best illustrated in FIGS. 19 and 20, at each corner of the top jack base 222 there is a circular opening 248. Mounted above each circular opening 248 is a support cap 250. Extending downwardly from each support cap 250 is a support rod 252.

It will be recalled from the discussion of FIG. 17 above that bushing supports 236 are mounted to the bottom jack base 226. Each bushing support 236 has a central opening 254 with a diameter sufficient to allow the support rod 252 to slide in and out thereof. Additionally, the outer diameter of the upper portion of the bushing support 236 is slightly smaller than that of the circular opening 248 to allow the upper portion of the bushing support 236 to be nested therein while the support rod 252 is positioned within the central opening 254 of the bushing support 236, as can be best appreciated from FIG. 19. This arrangement provides a limitation on the downward movement of the top jack base 222.

Each bushing support 236 includes a radial opening 256 as best seen in in FIG. 19. The radial opening 256 goes through the entire diameter of the bushing support 236. It is vertically located such that, when the inflatable cushion 224 is in its fully inflated state and the support rods 252 are at their highest location, the bottoms of the support rods 252 are just above the radial openings 256.

A right angle mounting bracket 258 is fastened to the bushing support 236 and an air cylinder 260 is mounted to the right angle mounting bracket 258. A locking pin 262 is affixed to the air cylinder 260 so that, when the cylinder is inflated, the locking pin 262 is positioned in and through the radial opening 256, as can be seen in FIG. 20. Since the cylindrical opening 256 extends through the entire bushing support 236, and because the locking pin 262 is sufficiently long to extend totally through the bushing support 236, the locking pin 262 is firmly anchored at two points and provides extremely solid support for the support rod 252. Thus, in the event of a sudden failure by the inflatable cushion 224, the locking pins 262 will allow only a very slight downward movement of the top jack base 222 and, accordingly, the roll 14.

As can be seen in FIG. 18, the radial openings 256, the air cylinders 260 and the locking pins 262 are all aligned in directions which are substantially tangent to the substantially circular inflatable cushion 224. This prevents any possibility of the locking pins 262 puncturing the inflatable cushion 224.

While the mechanisms just described provide limits for downward movement of the top jack base 222, it is also necessary to limit the upward movement thereof. Without such a limiting feature, the inflatable cushion 224 might accidentally become overinflated and might raise the top jack base 222 higher than necessary. Under extreme circumstances, this could even lift the support rods 252 out of the bushing supports 236, which would severely dislocate the entire apparatus.

To solve this problem, there is mounted to the bottom jack base 226 an upwardly extending yoke 264 having a central opening 266, as best seen in FIG. 21. The top jack base 222 has an opening 268 sufficiently large to accommodate the yoke 264. On both sides of the opening 268 there are mounted to the top jack base 222 downwardly extending plates 270, 272. Near the lower ends of the downwardly extending plates 270, 272 there is a safety pin 274 rigidly mounted to the plates 270, 272 and extending through the central opening 266 in the yoke 264.

As can be seen in FIG. 19, when the top jack base 222 is in its lower position, the safety pin 274 is positioned at the lower end of the central opening 266 while the upper end of the yoke 264 is positioned within and extends through the opening 268 in the top jack base 222. When the inflatable cushion 224 is inflated to raise the top jack base 222 to its higher position, the upward movement is limited by the interaction between the safety pin 274 and the upper end of the central opening 266, as can be seen in FIG. 20. As can be observed from FIG. 18, the entire arrangement just described appears on opposite sides of the cradle 202, wherein the corresponding reference numerals are designated with prime numbers.

As can be best seen in FIG. 18, there is a limit switch 276 mounted to the top jack base 222 which is positioned to detect the presence of the top portion of the yoke 264, which corresponds to the lowest position of the top jack base 222. The limit switch 276 thus provides a signal that the deflation of the inflatable cushion 224 can cease and that the entire pivot frame 200 can be moved out from under the roll 14.

As was mentioned above, it is necessary to provide for some clearance (i.e. ½ inch) between the bottom of pivot frame 200 and the floor. However, when the roll 14 is to be elevated, it is necessary for the bottom jack base 226 to rest on the floor; otherwise, the entire weight of the roll would be cantilevered on the pivot frame 200 and would be transmitted back to the pivot shaft 204, which could not conceivably support it.

To fully appreciate how this matter is resolved through the present invention, it should also be understood that there is an initial clearance between the cradle 202 and the roll 14 when the cradle 202 is positioned under the roll 14. At a bare minimum, this initial clearance must allow for the upper edges of the cradle 202 to clear the bottom of the roll when the cradle 202 is swung into position. When inflation of the inflatable cushion 224 begins, the top jack base 222 and thus the cradle 202 will move upward for some distance until the cradle 202 makes contact with the underside of the roll 14. When this occurs, as inflation of the inflatable cushion 224 continues, what then occurs is that the bottom jack base 226 begins to move downward. As previously discussed in connection with FIG. 17, when this begins to occur, the guide pins 240 move downward through the apertures 234 in the shelves 232, which are connected to the sidewall 230 of the pivot frame 200. Thus, the pivot frame 200 at all times remains essentially in the same position. Thus, after the cradle 202 makes contact with the roll 14, the inflatable cushion 224 follows the path of least resistance and thus pushes the bottom jack plate 226 downward until the feet 244 reach the floor. Once this occurs, the upward lifting of the roll 14 can begin, with the weight of the roll now being fully supported by the floor directly thereunder and with essentially no bending forces being transmitted to the pivot frame 200.

Figure 22:
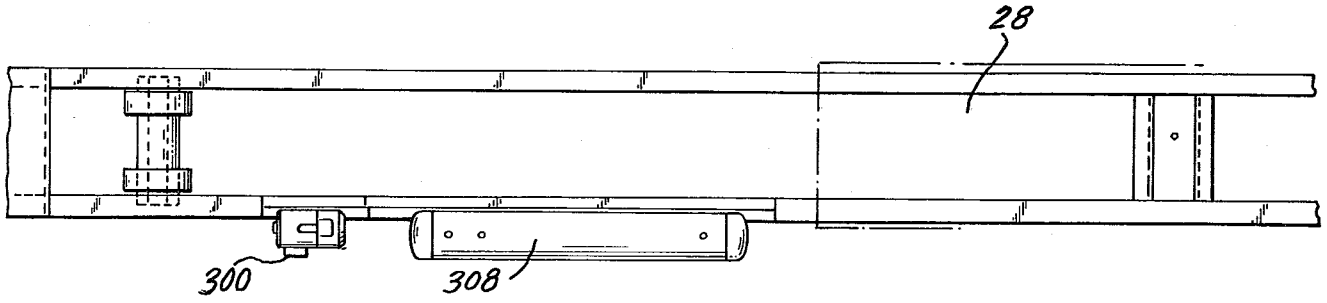
FIG. 22 is a plan view of the stretching apparatus illustrated in FIGS. 1 and 2 illustrating the pneumatic assembly.
Figure 23:
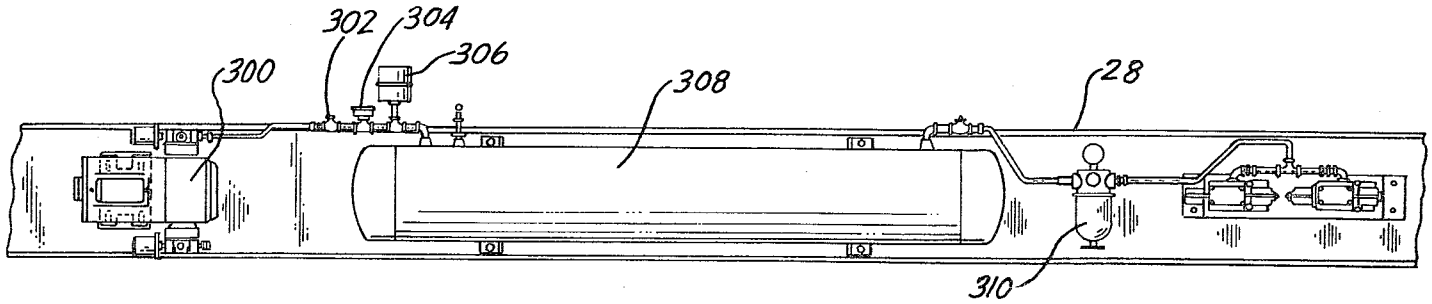
FIG. 23 is a partial front elevational view of the pneumatic assembly illustrated in FIG. 22 in a somewhat different scale.

It should be appreciated and understood, as explained more fully in U.S. Pat. No. 4,256,537 referred to above, that it is desirable to allow for the roll 14 to be at various locations along the tracks 20, 22, so that webs 12 of varying sizes can be processed. As has been just seen, the jacking mechanism depends on the use of compressed air in various ways. If the roll 14 is to be utilized in different locations, it might be necessary to continually move air hoses from one location to another. To avoid this problem, the present invention provides its own air supply mounted to the bridge 28. As illustrated in FIGS. 22 and 23, an air compressor 300 is mounted to the bridge 28 and is connected through check valve 302, pressure gauge 304, and pressure switch 306 to air tank 308, which provides a large reservoir of compressed air. The outlet of the air tank 308 passes through a filter regulator 310. Thereafter, conventional valves, switches and connectors supply compressed air to the inflatable cushion 224, as well as to the air cylinders 260.

The operation of the embodiment of the present invention which has thus far been described will now be explained. After the processing of the web 12 has been completed, the bridge 28, along with the first carriage 24 and the second carriage 26, are moved a few feet toward the other end of the web 12 in order to release some of the tension on the web 12. In order to remove the web 12 from the roll 14, it is necessary that it be located on the cantilever side of the roll 14. If this has not been done, it must be accomplished prior to the removal operation.

Prior to the removal operation, the pivot frame 200 is in a position underneath the bridge 28. To begin the removal operation, the electrical actuator 216 moves the actuator arm 218 outward. This in turn rotates the pivot arm 214 which, in turn, rotates the pivot shaft 204. That in turn swings the entire pivot frame 200 ninety degrees to a location whereby the cradle 202 is positioned under the roll 14.

The inflation of the inflatable cushion 224 begins, which causes the cradle 202 to begin rising until it makes contact with the underside of roll 14. As previously described, the bottom jack base 226 then moves downward until it reaches the floor. As inflation continues, the cradle 202 resumes its upward movement and elevates the middle portion of the roll 14. Since the center of gravity in the roll 14 is located between the cradle 202 and the first carriage 24, the roll 14 becomes supported by cradle 202 and the first carriage 24. Moreover, since the tapering shaft 90 on the pivot side is restrained by the roller bearing 92, the roll 14 has no choice but for the cantilever side to move upward. Thus, the bearing housing 130 on the cantilever side disengages from the U-shaped support 136 and is lifted above it, as can be best seen in FIG. 1.

To remove the web 12, it might initially appear that the cantilever side of roll 14 would have to be lifted a distance sufficient to allow the bottom of the second end 18 of the roll 14 to clear the upper portions of the second carriage 26. However, as will how be explained, this is not necessary.

It should now be recalled that the second carriage 26 is detachable from the bridge 28 by means of disconnect pin 100. It will also be appreciated from FIG. 8 that the U-shaped support 136 is somewhat shorter on the side facing bridge 28 than it is on the opposite side. All that is needed is for the bearing housing 130 to be lifted approximately 3 or 4 inches in order for it to be clear of the second carriage 26 when the second carriage 26 is moved toward the right as seen in FIG. 8. Thus, to provide access to the roll 14, all that is needed is for the bearing housing to be lifted 3 to 4 inches until it clears the U-shaped support 136. The second carriage 26 may then be moved out of the way to provide clear access. In the present embodiment, the total upward travel of the cradle 202 is approximately 4-15/16 inches. This produces a pivot angle of one to two degrees at the pivot side. This translates into an upward travel of the bearing housing 130 on the cantilever side of approximately 9¼ inches, which is more than enough to allow removal of the second carriage 26.

To continue with the description of the operation of the present invention, the inflation of the inflatable cushion 224 continues until upward movement of the top jack base 222 is stopped by the safety pins 274. The air cylinders 260 are then actuated so that the locking pins 262 enter the bushing supports 236 through the radial openings 256.

With these four safety devices now in place, the disconnect pin 100 can simply be lifted out and the entire second carriage 26 may be moved to the right as seen in FIG. 8 to provide clear access to the entire second end 18 of the roll 14. The web 12 can then be readily removed and, if desired, a new web can be placed on the roll 14. The second carriage 26 is then moved to the left and is reconnected to the bridge 28 with the disconnect pin 100.

At this time, through appropriate signaling and switching, the air cylinders 260 are then caused to retract, thus removing the locking pins 262 from the bushing supports 236. Air is then released from the inflatable cushion 224 in a gradual manner, which causes the cradle 202 to be lowered. This, in turn, causes the second end 18 of the roll 14 to be lowered so that the bearing housing 130 is lowered into the U-shaped support 136. The truncated A-shaped protruding member 138 interacts with the truncated V-shaped groove 134 to assist in guiding the bearing housing into position.

As downward movement of the roll 14 ceases, the deflation of the inflatable cushion 224 continues. At this stage, the springs 242 urge the flanges 238 upward, which in turn lifts the bottom jack base 226 off the ground. When the relative movement of the top jack base 222 and the bottom jack base 226 toward each other reaches its limit, the limit switch 276 is actuated by virtue of the yoke 264 having extended to and through the opening 268. This provides a signal that the cradle 202 may be moved out from under the roll 14. To accomplish this, the electrical actuator 216 is then operated in its reverse direction so that the actuator arm 218 moves downward as seen in FIG. 13. This, in turn, swivels the pivot arm 214 in a counterclockwise direction, which pivots the pivot shaft 204 and which thus rotates the entire pivot frame 200 in a counterclockwise direction until the cradle 202 is positioned underneath the bridge 28.

Referring now to FIGS. 24 through 29, an alternative embodiment of the lifting mechanism is disclosed, which does not rely upon the use of an inflatable cushion but instead operates with a mechanical linkage.

Figure 25:
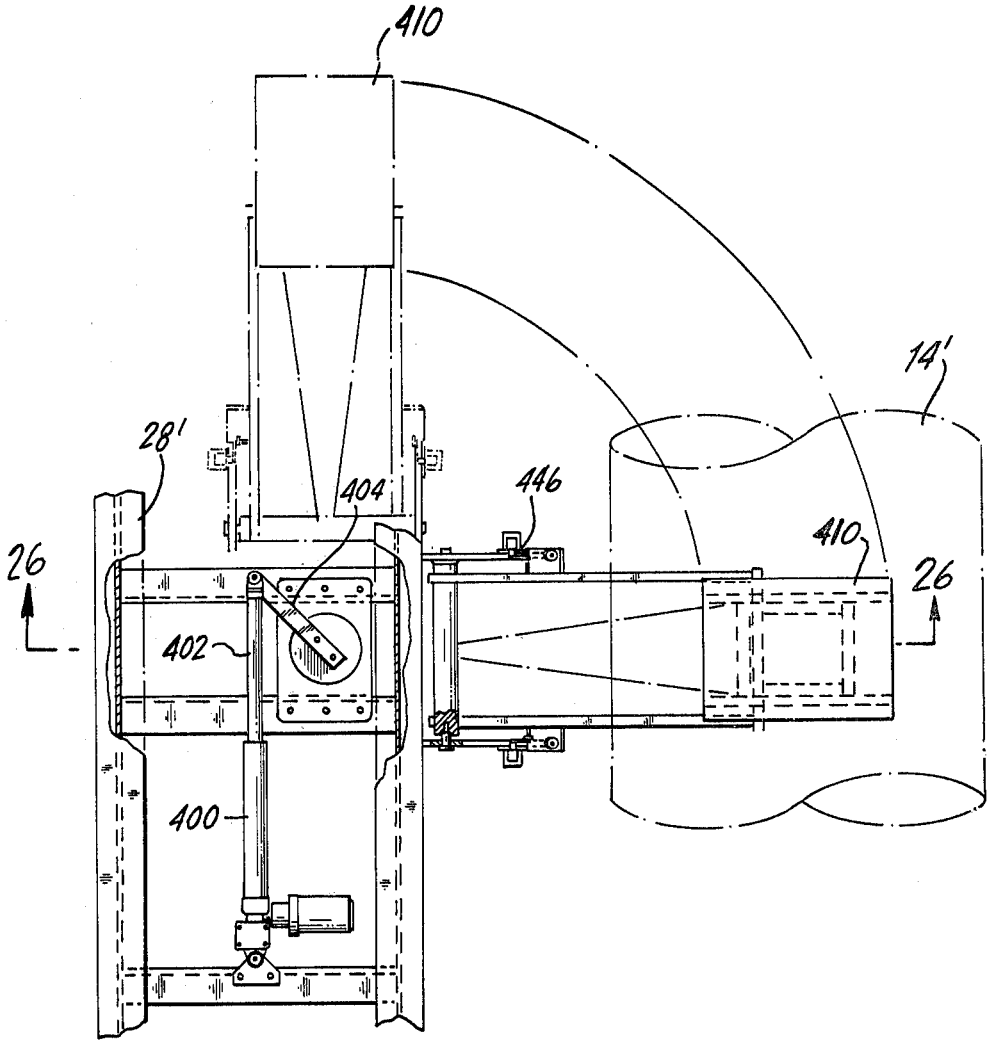
FIG. 25 is a partial plan view of the alternative embodiment illustrated in FIG. 24.

As can be appreciated from FIG. 25, the lifting mechanism is mounted to the bridge 28' and the mechanism for pivoting the jacking device from a position below the bridge 28' to a position below the roll 14' is essentially the same as the arrangement previously discussed. Stated briefly, there is an actuator 400 which operates an actuator arm 402 which in turn causes a pivot arm 404 to rotate clockwise or counterclockwise as seen in FIG. 25. This causes the pivot shaft 406 to rotate with it which, in turn, pivots the frame 408.

Cradle 410, which is adapted to engage with and lift the roll 14', is positioned substantially vertically above the block 412. First links 414 are pivotally mounted to the block 412 and second links 416 are pivotally mounted to the first links 414 at pivots 418. The upper ends of the second links 416 are pivotally mounted to the cradle 410. A central frame 422 is pivotally mounted to the pivots 418. The cradle 410 is rigidly mounted to upper frame 428 which is pivotally mounted to the second links 416 through upper pivot 426. The lower frame 420 is pivotally mounted to the block 412 and the first links 414 through lower pivot 424.

Figure 24:
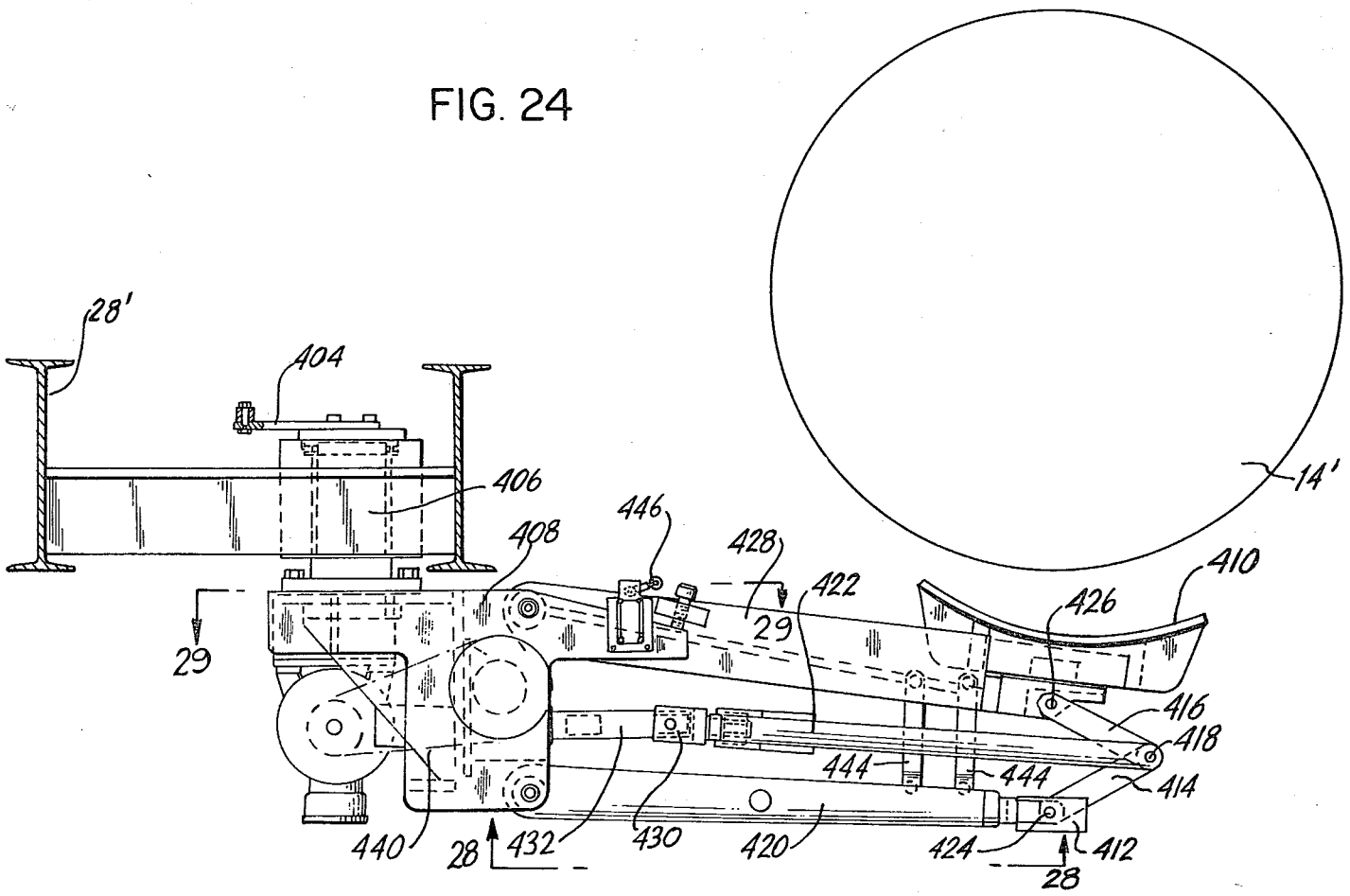
FIG. 24 is a right side elevational view of an alternative embodiment of the lifting means of the present invention.
Figure 26:
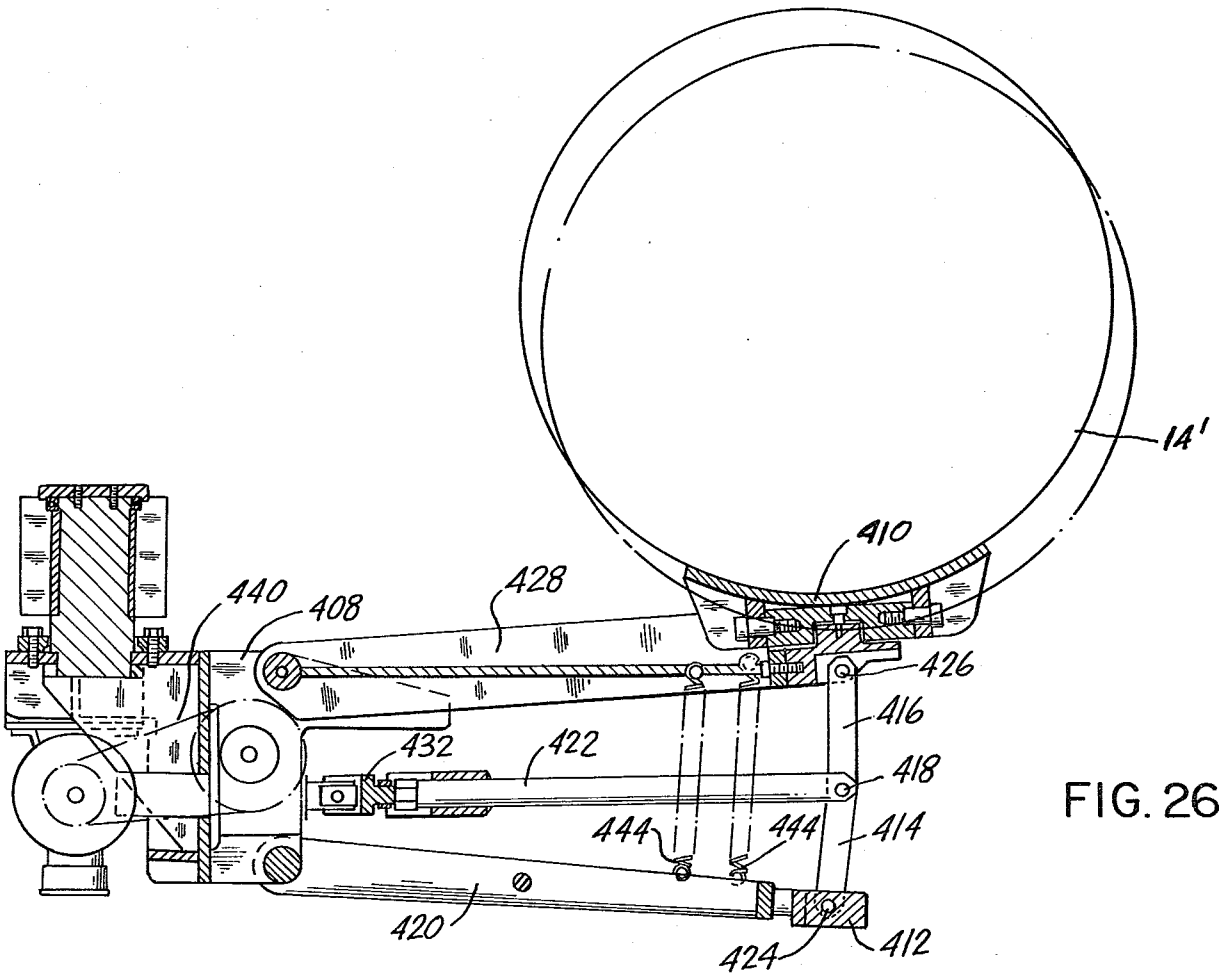
FIG. 26 is a right side elevational section view taken along the line 26—26 in FIG. 25 and looking in the direction of the arrows, which illustrates the alternative embodiment of the lifting means when in its elevated position.
Figure 28:
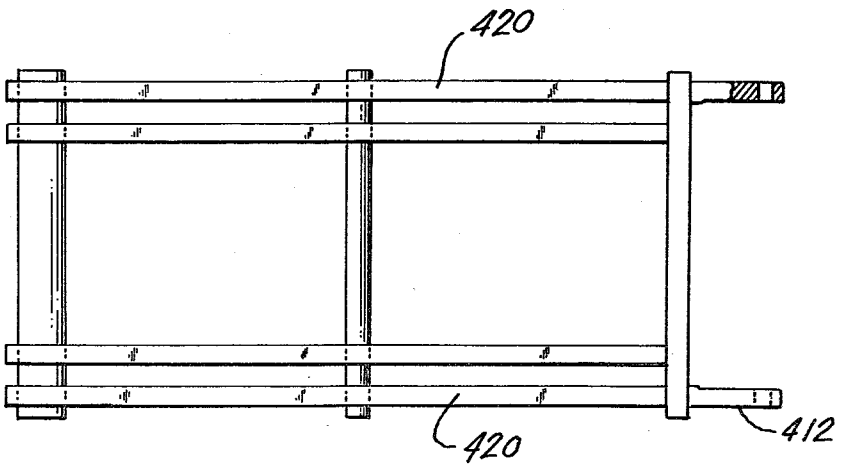
FIG. 28 is a partial bottom view taken along the line 28—28 in FIG. 24 and looking in the direction of the arrows.
Figure 27:
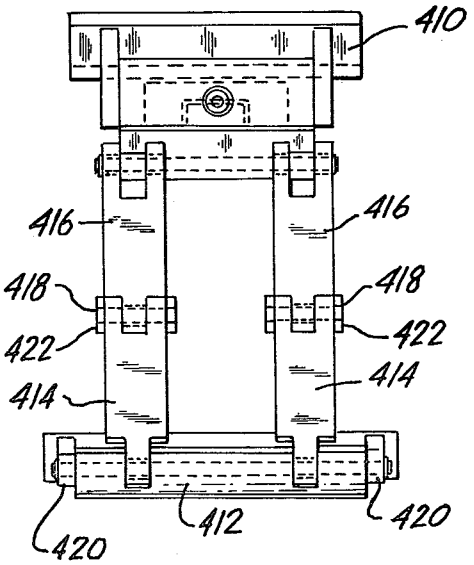
FIG. 27 is a rear elevational view of the alternative embodiment of the lifting means in the position illustrated in FIG. 26.
Figure 29:
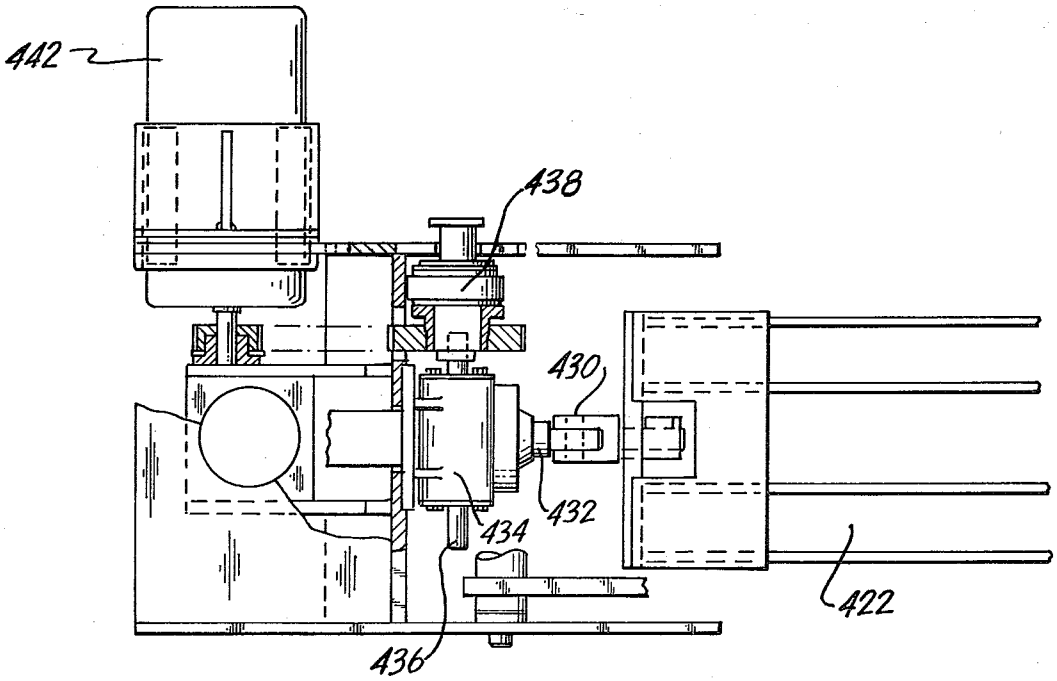
FIG. 29 is a partial sectional plan view taken along the line 29—29 in FIG. 24 and looking in the direction of the arrows.

The central frame 422 acts as an actuating member for raising the cradle 410. To accomplish this, the left-hand end of central frame 422 as seen in FIGS. 24 and 26 is mounted through pivot 430 to shaft 432. Shaft 432 is designed to move to the left and to the right by means of worm gear box 434, as best seen in FIG. 29. The input shaft 436 of the worm gear box 434 is driven through a torque coupling 438 by a belt or chain 440, as best seen in FIGS. 24 and 26. The belt or chain is, in turn, driven by a motor 442.

The jacking mechanism is normally retained in its lowered position, as seen in FIG. 24, through springs 444, which urge the upper frame 428 toward the lower frame 420 and which, in turn, urges the first link 414 and the second link 416 to form an acute angle about central pivots 418 with the central pivot 418 horizontally displaced from the lower pivot 424 and the upper pivot 426. To provide sufficient clearance during pivoting, the block 412 should provide some minimal clearance above the floor when the apparatus is in the position illustrated in FIG. 24.

To lift the roll 14', the motor 442 is activated which, through the belt or chain 440, the torque coupling 438, the worm gear box 434 and the input shaft 436 pulls the central frame 422 toward the left, as seen in FIGS. 24 and 26. This, in turn, moves the central pivot 418 inwardly which causes the first link 414 and the second links 416 to erect into substantially vertical positions wherein the central pivot 418 is substantially vertically aligned with the lower pivot 424 and the upper pivot 426. This in turn causes the block 412 to move downward until the floor is reached and causes the cradle 410 to move upwardly to engage the roll 14' and lift it upward. A limit switch 446 is provided to detect when the apparatus has reached the erected position illustrated in FIG. 26.

After the web has been removed, the procedure is reversed, whereby the motor 442 is reversed and whereby the central frame 422 moves toward the right to collapse the apparatus, to lower the cradle 410 below the roll 14' and to lift the block 412 above the floor. The entire apparatus is then pivoted under the bridge 28'.

As will be readily apparent to those skilled in the art, the invention may be used in other specific forms of stretching apparatus without departing from its spirit or essential characteristics. The present embodiments are, therefore, to be considered as illustrative and not restrictive, the scope of the invention being indicated by the claims rather than the foregoing description, and all changes which come within the meaning and range of equivalence of the claims are therefore intended to be embraced therein.

What is claimed is:

1. Apparatus for processing an endless web, comprising:

support means for supporting said endless web at a first location thereof;

a roll for supporting said endless web at a second location thereof, said roll having first and second ends;

first and second track means extending between said first and second locations;

first and second carriage means engaged to said first and said second track means respectively for rotatably supporting said first and second ends of said roll respectively in a normal operating position and moving said roll relative to said support means along said track means;

bridge means connecting said first and second carriage means; and means mounted to said bridge means for lifting said roll at a location between said first and second ends so that said roll is supported by said lifting means and said first carriage means whereby said endless web may be inserted or removed over said second end of said roll.

2. Apparatus according to claim 1 wherein said second carriage means is releasably detachable from said bridge means.

3. Apparatus according to claim 1 or claim 2 wherein said first carriage means is integral with said bridge means.

4. Apparatus according to claim 1 wherein said roll includes a center of gravity and wherein said lifting means is positioned between said center of gravity and said second end of said roll.

5. Apparatus according to claim 1 wherein said lifting means includes frame means, cradle means mounted to said frame means for supporting said roll, positioning means for moving said frame means into and out of a position wherein said cradle means is located underneath said roll, and means for elevating said cradle means while said cradle means is in said location underneath said roll.

6. Apparatus according to claim 5 wherein said positioning means includes a substantially vertical shaft rigidly mounted to said frame means, bearing means rigidly mounted to said bridge means for rotatably mounting said shaft, and means for rotating said shaft.

7. Aparatus according to claim 6 wherein said frame means is located below said bridge means and wherein said shaft extends downwardly from said bearing means to said frame means.

8. Apparatus according to claim 5 wherein said elevating means comprises an inflatable cushion adapted to be inflated and thereby raise said cradle means and to be deflated and thereby lower said cradle means.

9. Apparatus according to claim 8 further comprising air supply means mounted to said bridge means to supply air to said inflatable cushion.

10. Apparatus according to claim 1 wherein said lifting means comprises frame means, bottom plate means mounted to said frame means for vertical movement with respect thereto, means for urging said bottom plate means upwardly with respect to said frame means, top plate means slidably mounted to said bottom plate means for vertical movement relative thereto, cradle means mounted to said top plate means adapted to engage with said roll, inflatable cushion means positioned between said bottom plate means and said top plate means adapted to urge said top plate means upward so that said cradle means engages said roll and to urge said bottom plate means downward when inflated, and positioning means for moving said frame means into and out of a position wherein said cradle means is located underneath said roll.

11. Apparatus according to claim 10 further comprising air supply means mounted to said bridge means to supply air to said inflatable cushion.

12. Apparatus according to claim 10 further comprising means for locking said top plate means to prevent downward movement of said top plate when said cradle means is engaged with said roll.

13. Apparatus according to claim 12 wherein said locking means includes at least one pin mounted to obstruct said slidable relative vertical movement between said top plate means and said bottom plate means.

14. Apparatus according to claim 5 wherein said elevating means comprises a block adapted to rest on the ground, a first link having first and second ends, said first end being pivotally mounted to said block, a second link having first and second ends, said first end being pivotally mounted to said cradle means, pivot means for pivotally mounting said second end of said first link to said second end of said second link, and means for moving said pivot means between a first position horizontally displaced from said first ends of said links, wherein said cradle means is vertically positioned a relatively short distance above said block, and a second position wherein said pivot means is substantially vertically aligned with said first ends of said first and said second links, wherein said first and second links support said cradle means and said cradle means is vertically positioned a relatively large distance above said block.

15. Apparatus according to claim 14 further comprising an upper frame member pivotally mounted to said frame means and wherein said cradle means and said first end of said second link are pivotally mounted to said upper frame member.

16. Apparatus according to claim 14 further comprising a lower frame member pivotally mounted to said frame means and wherein said block and said first end of said first link are pivotally mounted to said lower frame member.

17. Apparatus according to claim 14 wherein said moving means comprises a central frame member mounted to said pivot and means for horizontally displacing said central member.

* * * * *